US011679474B2

(12) United States Patent
Huang et al.

(10) Patent No.: US 11,679,474 B2
(45) Date of Patent: Jun. 20, 2023

(54) PEEP-HOLE SOCKET DRIVING SHANK ASSEMBLY

(71) Applicants: Hsuan-Yu Huang, Taichung (TW); Bing-Cheng Liao, Taichung (TW)

(72) Inventors: Hsuan-Yu Huang, Taichung (TW); Bing-Cheng Liao, Taichung (TW)

( * ) Notice: Subject to any disclaimer, the term of this patent is extended or adjusted under 35 U.S.C. 154(b) by 94 days.

(21) Appl. No.: 17/347,710

(22) Filed: Jun. 15, 2021

(65) Prior Publication Data

US 2022/0395966 A1 Dec. 15, 2022

(51) Int. Cl.

| | |
|---|---|
| ***B25B 13/48*** | (2006.01) |
| ***B25B 23/00*** | (2006.01) |
| ***B25B 23/12*** | (2006.01) |
| ***B25B 13/46*** | (2006.01) |
| ***B25B 21/00*** | (2006.01) |

(52) U.S. Cl.

CPC ..... *B25B 13/481* (2013.01); *B25B 23/0035* (2013.01); *B25B 23/12* (2013.01); *B25B 13/462* (2013.01); *B25B 21/00* (2013.01)

(58) Field of Classification Search

CPC ..... B25B 13/481; B25B 13/06; B25B 15/001; B25B 21/00; B25B 21/0007; B25B 21/0035; B25B 21/12

USPC .... 81/57.15, 57.13, 57.14, 57.32, 57.33, 60, 81/120, 121.1

See application file for complete search history.

(56) References Cited

U.S. PATENT DOCUMENTS

| | | | | |
|---|---|---|---|---|
| 5,938,212 | A * | 8/1999 | Wadsworth | B23B 31/202 279/42 |
| 6,321,855 | B1 * | 11/2001 | Barnes | B25B 23/00 279/157 |
| 6,354,176 | B1 * | 3/2002 | Nordlin | B25B 13/06 81/121.1 |
| 7,127,969 | B2 * | 10/2006 | Hsieh | B25B 13/06 81/120 |
| 7,313,988 | B2 * | 1/2008 | Williams | B25B 27/0035 81/177.85 |
| 8,205,529 | B1 * | 6/2012 | Laurie | B25B 23/0021 81/177.85 |
| 8,844,941 | B1 * | 9/2014 | Dickrede | B23G 1/46 279/42 |
| 9,352,455 | B2 * | 5/2016 | Steele | B25B 13/06 |
| 2009/0162164 | A1 * | 6/2009 | Bohl | F16L 19/063 403/1 |
| 2011/0048175 | A1 | 3/2011 | LeVert | |

* cited by examiner

*Primary Examiner* — Lee D Wilson
*Assistant Examiner* — Robert F Neibaur
(74) *Attorney, Agent, or Firm* — Alan D. Kamrath; Karin L. Williams; Mayer & Williams PC

(57) ABSTRACT

A driving shank assembly includes a tube, a drive head, a connector, and two quick release nuts. The tube has two enlarged portions each having a mounting recess and an external thread. Each of the enlarged portions has a plurality of slits and a plurality of elastic clamping pieces between the slits. The drive head has a driving recess and a mounting shaft. The mounting shaft of the drive head is inserted into the mounting recess of the tube. The connector has a mounting shaft and a connecting shank. The mounting shaft of the connector is inserted into the mounting recess of the tube. The connecting shank of the connector has a retaining groove for mounting an actuating tool. Each of the quick release nuts has an internal thread screwed onto the external thread of the tube.

8 Claims, 17 Drawing Sheets

B - B

E - E

R-R

U - U

PEEP-HOLE SOCKET DRIVING SHANK ASSEMBLY

BACKGROUND OF THE INVENTION

1. Field of the Invention

The present invention relates to a hand tool and, more particularly, to a deep-hole socket driving shank assembly.

2. Description of the Related Art

A conventional deep-hole socket driving shank assembly in accordance with the prior art shown in FIGS. 1-4 comprises a tube 70 having a first end provided with a driving head 71, and a connecting member 72 having a first end secured to a second end of the tube 70 by welding and a second end provided with a shank 74. The driving head 71 is provided with a driving recess 73. The shank 74 is provided with an annular groove 75 for locking an electric tool 1. In practice, two bolts 61 are mounted on a ceiling. A support plate 62 is mounted between the two bolts 61. Two nuts 63 are screwed onto the two bolts 61 and rest on the bottom of the support plate 62 to support the support plate 62. Thus, the support plate 62 is used to support a vent pipe or a fire hose. The driving recess 73 of the driving head 71 is mounted on each of the two nuts 63. The electric tool 1 is connected with the shank 74 of the connecting member 72. In operation, the connecting member 72 is driven by the electric tool 1 to rotate the tube 70 which rotates the driving head 71 which rotates each of the two nuts 63 so that each of the two nuts 63 is screwed onto or unscrewed from each of the two bolts 61. However, the tube 70 and the connecting member 72 are not coaxial and have a poor circularity therebetween so that the tube 70 is easily deflected during rotation. In addition, the tube 70, the driving head 71, and the connecting member 72 are formed integrally so that the tube 70, the driving head 71, and the connecting member 72 cannot be dismantled, so that the driving head 71 cannot be available for nuts of different sizes and specifications.

A conventional hollow shank power nut driver was disclosed in the U.S. Publication No. 2011/0048175, and comprises a hollow column, a threaded rod, and a drive shaft. The hollow column has an interior provided with a hollow space. The hollow column has a first end provided with a mounting hole mounted on a nut. The threaded rod extends through the mounting hole into the hollow space. The drive shaft is secured to a second end of the hollow column by soldering.

BRIEF SUMMARY OF THE INVENTION

In accordance with one embodiment of the present invention, there is provided a driving shank assembly comprising a tube, a drive head, and a quick release nut. The tube is hollow and has a straight shape. The tube has an enlarged portion formed on one end thereof. The enlarged portion has an interior provided with a mounting recess for mounting the drive head. The enlarged portion has an exterior provided with an external thread for locking and securing the quick release nut. The enlarged portion has a periphery provided with a plurality of slits and a plurality of elastic clamping pieces between the slits. Each of the slits is connected to the mounting recess and extends axially along the tube. The drive head has a first end provided with a driving recess and a second end provided with a mounting shaft. The mounting shaft of the drive head is inserted into the mounting recess of the tube. The quick release nut has an interior provided with an internal thread screwed onto the external thread of the tube.

In accordance with another embodiment of the present invention, there is provided a driving shank assembly comprising a tube, a connector, and a quick release nut. The tube is hollow and has a straight shape. The tube has an enlarged portion formed on one end thereof. The enlarged portion has an interior provided with a mounting recess for mounting the connector. The enlarged portion has an exterior provided with an external thread for locking and securing the quick release nut. The enlarged portion has a periphery provided with a plurality of slits and a plurality of elastic clamping pieces between the slits. Each of the slits is connected to the mounting recess and extends axially along the tube. The connector has a first end provided with a mounting shaft and a second end provided with a connecting shank. The mounting shaft of the connector is inserted into the mounting recess of the tube. The connecting shank of the connector is provided with at least one retaining groove for mounting an actuating tool. the at least one retaining groove has an annular shape. The quick release nut has an interior provided with an internal thread screwed onto the external thread of the tube.

In accordance with a further embodiment of the present invention, there is provided a driving shank assembly comprising a tube, a drive head, a connector, and two quick release nuts. The tube is hollow and has a straight shape. The tube has two enlarged portions formed on two ends thereof. Each of the two enlarged portions has an interior provided with a mounting recess for mounting the drive head and the connector respectively. Each of the two enlarged portions has an exterior provided with an external thread for locking and securing the two quick release nuts. Each of the two enlarged portions has a periphery provided with a plurality of slits and a plurality of elastic clamping pieces between the slits. Each of the slits is connected to the mounting recess and extends axially along the tube. The drive head has a first end provided with a driving recess and a second end provided with a mounting shaft. The mounting shaft of the drive head is inserted into the mounting recess of the tube. The connector has a first end provided with a mounting shaft and a second end provided with a connecting shank. The mounting shaft of the connector is inserted into the mounting recess of the tube. The connecting shank of the connector is provided with at least one retaining groove for mounting an actuating tool. The at least one retaining groove has an annular shape. Each of the two quick release nuts has an interior provided with an internal thread screwed onto the external thread of the tube.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
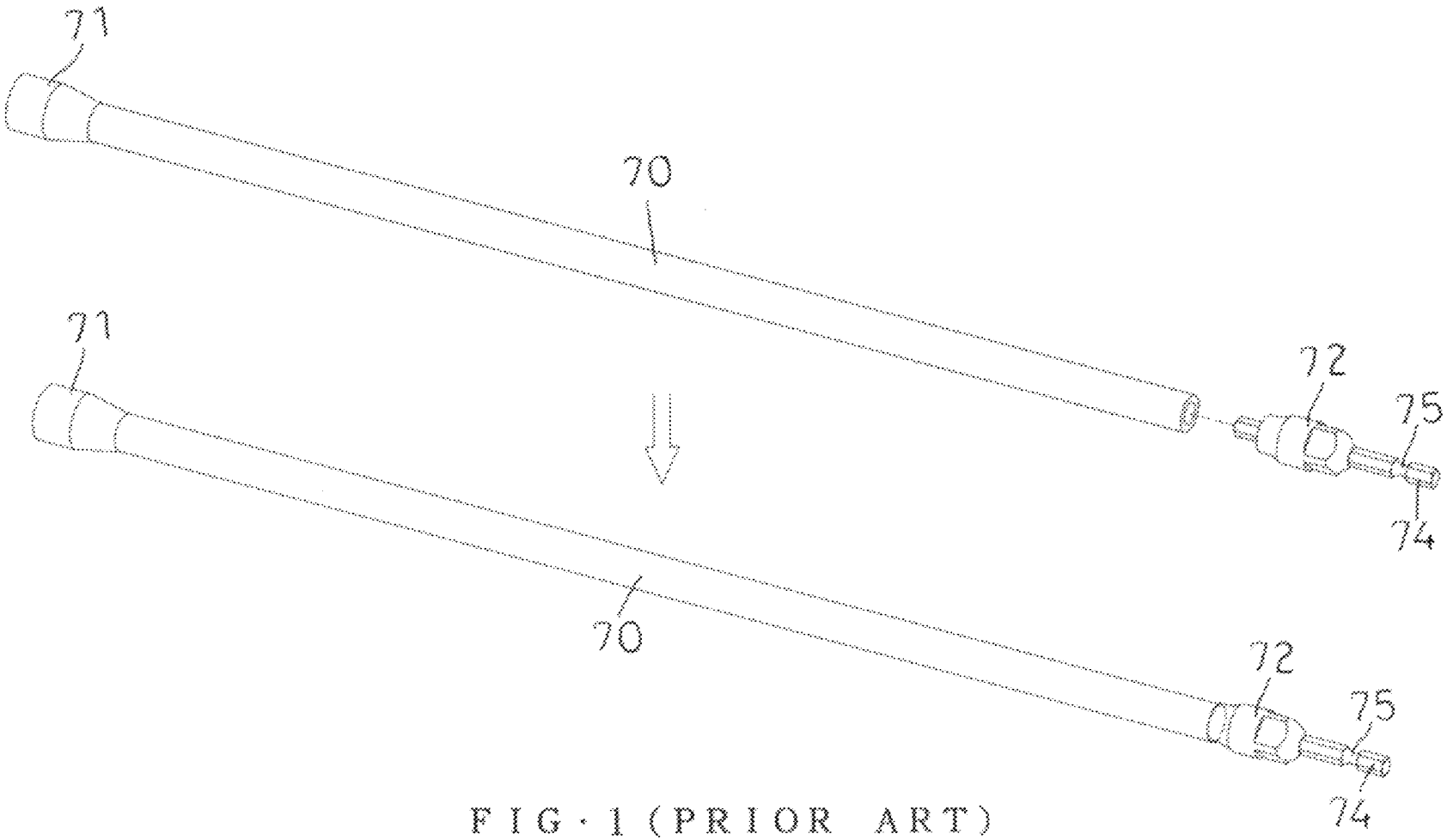
FIG. 1 (PRIOR ART)
FIG. 1 is a perspective view of a conventional driving shank in accordance with the prior art.
Figure 3:
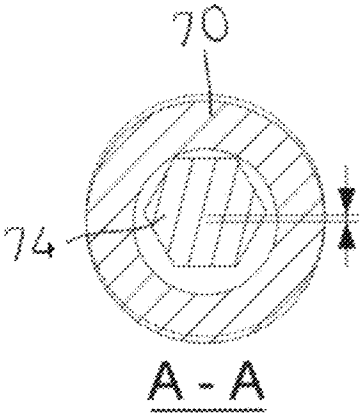
FIG. 3 (PRIOR ART)
FIG. 3 is a cross-sectional view of the conventional driving shank taken along line A-A as shown in FIG. 2.
Figure 2:
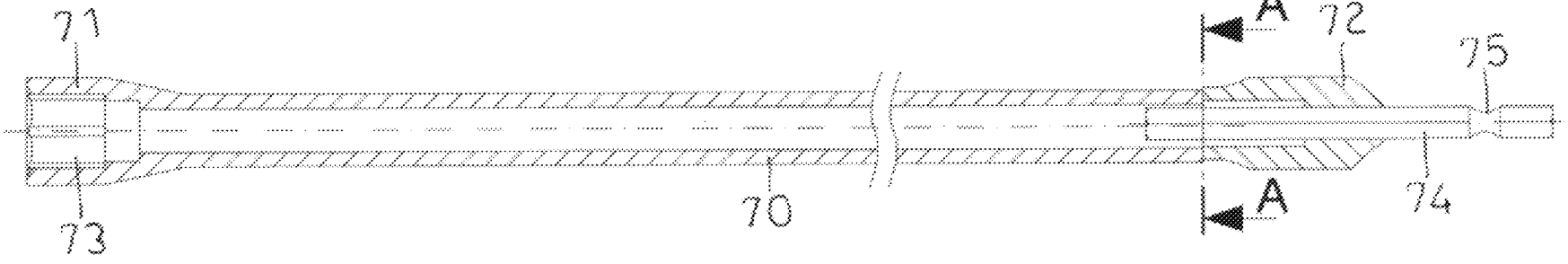
FIG. 2 (PRIOR ART)
FIG. 2 is a cross-sectional view of the conventional driving shank in accordance with the prior art.
Figure 4:
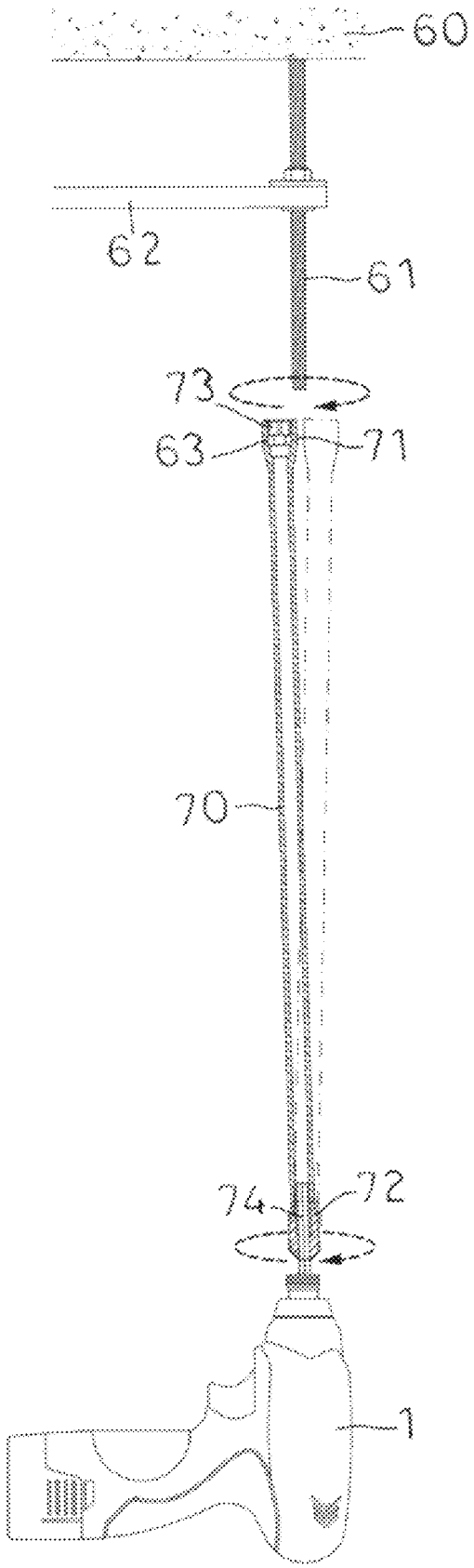
FIG·4 (PRIOR ART)
FIG. 4 is a schematic cross-sectional view showing operation of the conventional driving shank in accordance with the prior art.
Figure 5:
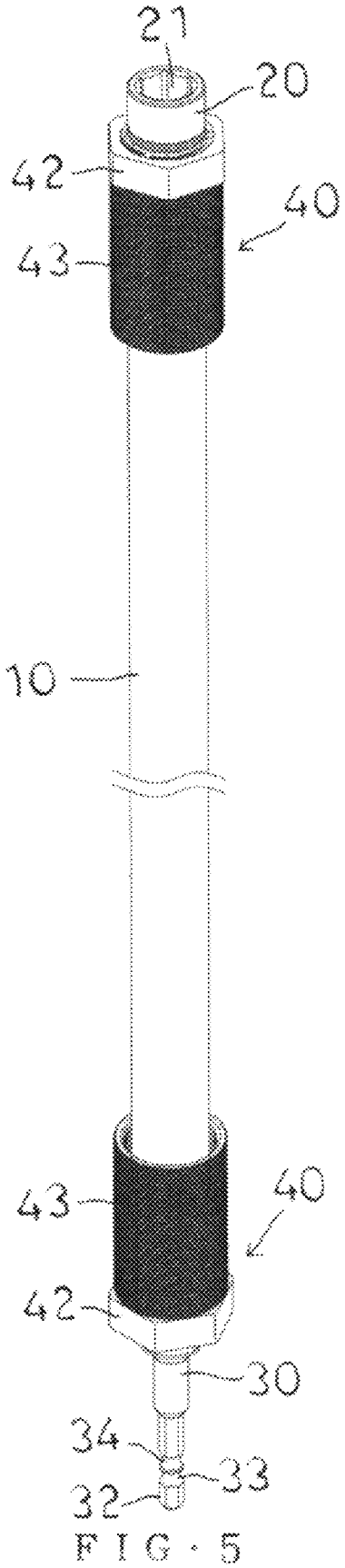
FIG. 5 is a perspective view of a driving shank assembly in accordance with the first preferred embodiment of the present invention.
Figure 6:
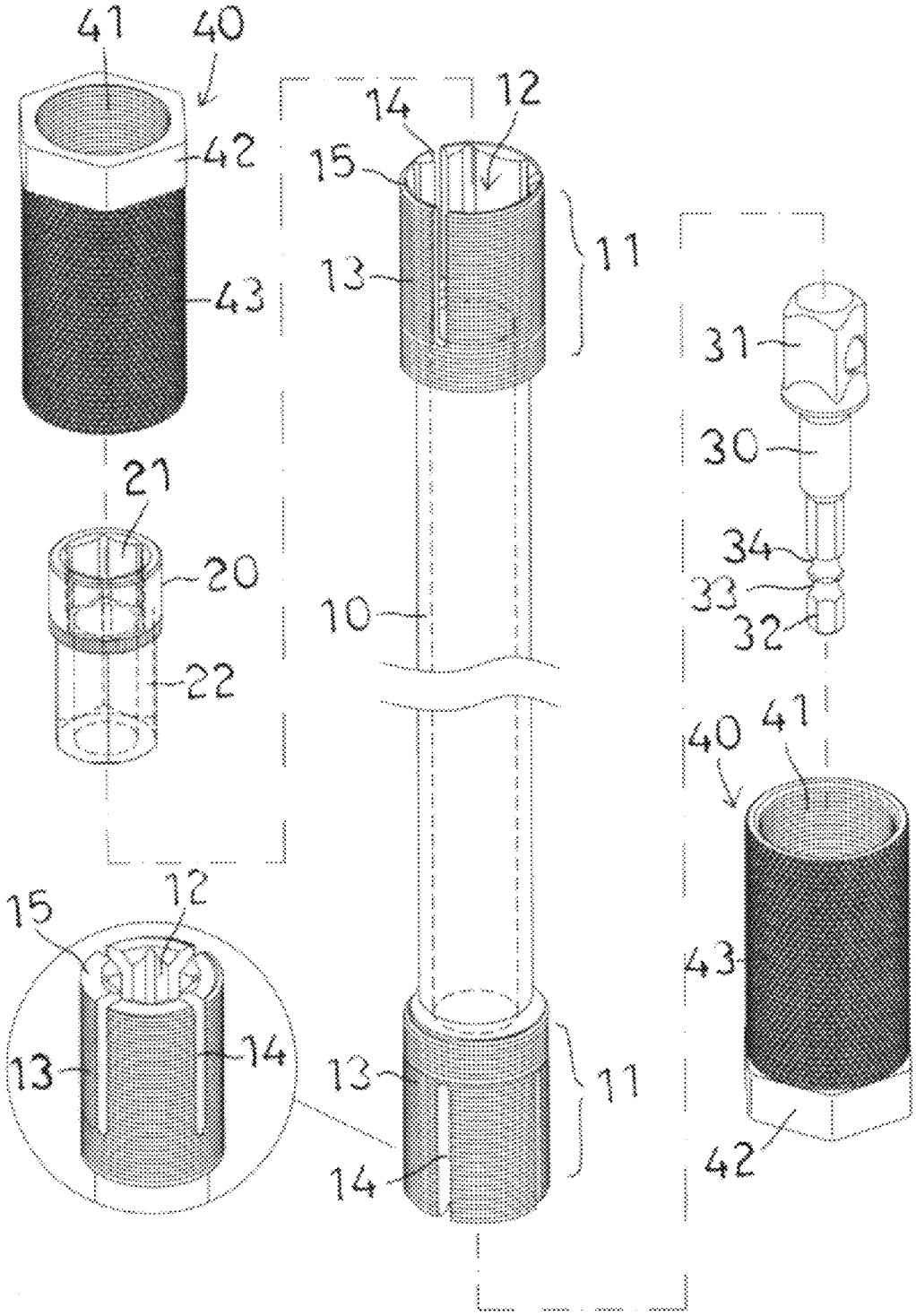
FIG. 6 is an exploded perspective view of the driving shank assembly in accordance with the first preferred embodiment of the present invention.
Figure 7:
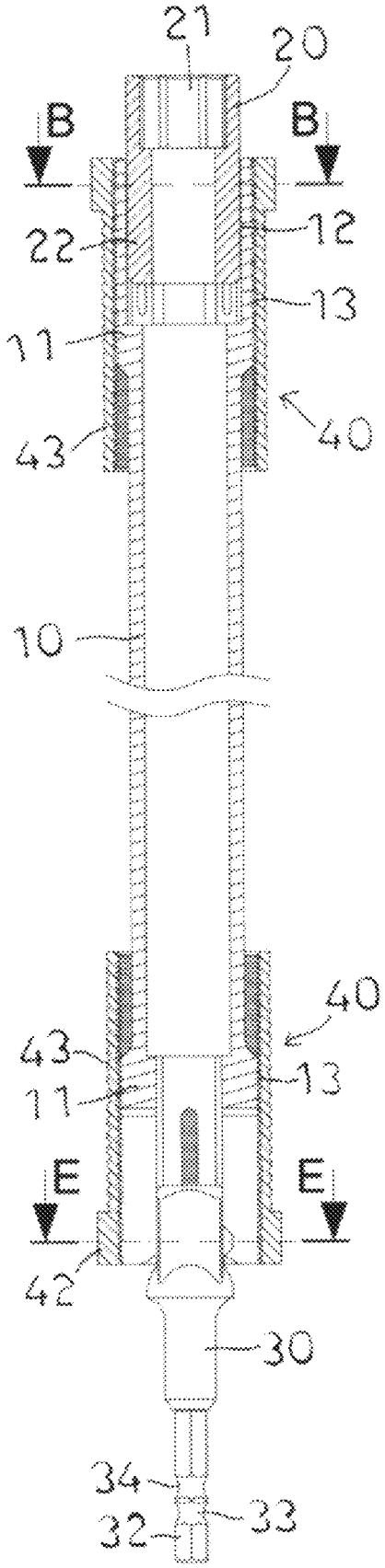
FIG. 7 is a cross-sectional view of the driving shank assembly in accordance with the first preferred embodiment of the present invention.
Figure 8:
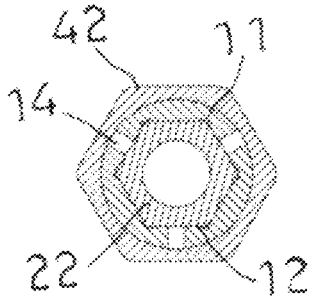
FIG. 8 is a cross-sectional view of the driving shank assembly taken along line B-B as shown in FIG. 7.
Figure 9:
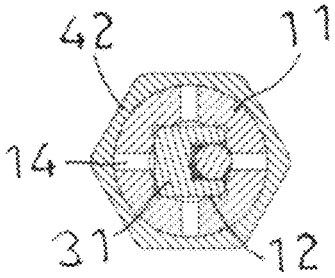
FIG. 9 is a cross-sectional view of the driving shank assembly taken along line E-E as shown in FIG. 7.

Referring to the drawings and initially to FIGS. 5-9, a driving shank assembly in accordance with the first preferred embodiment of the present invention comprises a tube 10, a drive head 20, a connector 30, and two quick release nuts 40.

The tube 10 is hollow and has a straight shape. The tube 10 has two enlarged portions 11 formed on two ends thereof. Each of the two enlarged portions 11 has a diameter more than that of the tube 10. Each of the two enlarged portions 11 has an interior provided with a mounting recess 12 for mounting the drive head 20 and the connector 30 respectively. The mounting recess 12 has a hexagonal shape or a square shape. Each of the two enlarged portions 11 has an exterior provided with an external thread 13 for locking and securing the two quick release nuts 40. Each of the two enlarged portions 11 has a periphery provided with a plurality of slits 14 and a plurality of elastic clamping pieces 15 between the slits 14. Each of the slits 14 is connected to the mounting recess 12 and extends axially along the tube 10. The elastic clamping pieces 15 are made flexible by the slits 14.

The drive head 20 has a first end provided with a driving recess 21 and a second end provided with a mounting shaft 22. The driving recess 21 of the drive head 20 has a hexagonal shape or a square shape. The mounting shaft 22 of the drive head 20 has a shape corresponding to that of the mounting recess 12 of the tube 10. Preferably, the mounting shaft 22 of the drive head 20 has a hexagonal shape or a square shape. The drive head 20 has different sizes and specifications corresponding to that of different nuts. A magnetic member is mounted in the driving recess 21 of the drive head 20.

The connector 30 has a first end provided with a mounting shaft 31 and a second end provided with a connecting shank 32. The mounting shaft 31 of the connector 30 has a shape corresponding to that of the mounting recess 12 of the tube 10. Preferably, the mounting shaft 31 of the connector 30 has a hexagonal shape or a square shape. The connecting shank 32 of the connector 30 is provided with two retaining grooves 33 and 34. Each of the two retaining grooves 33 and 34 has an annular shape and is available for mounting an actuating tool, such as an electric tool 1 (FIG. 12) of a U.S. specification or a Japanese specification.

Each of the two quick release nuts 40 has an interior provided with an internal thread 41 screwed onto the external thread 13 of the tube 10. Each of the two quick release nuts 40 has an exterior provided with a driving portion 42. Preferably, the driving portion 42 of each of the two quick release nuts 40 has a hexagonal shape. A wrench tool is mounted on the driving portion 42 to drive and rotate each of the two quick release nuts 40. Each of the two quick release nuts 40 is provided with a knurling (or embossing) portion 42 to increase the friction thereof and to facilitate a user holding and operating each of the two quick release nuts 40.

Figure 10:
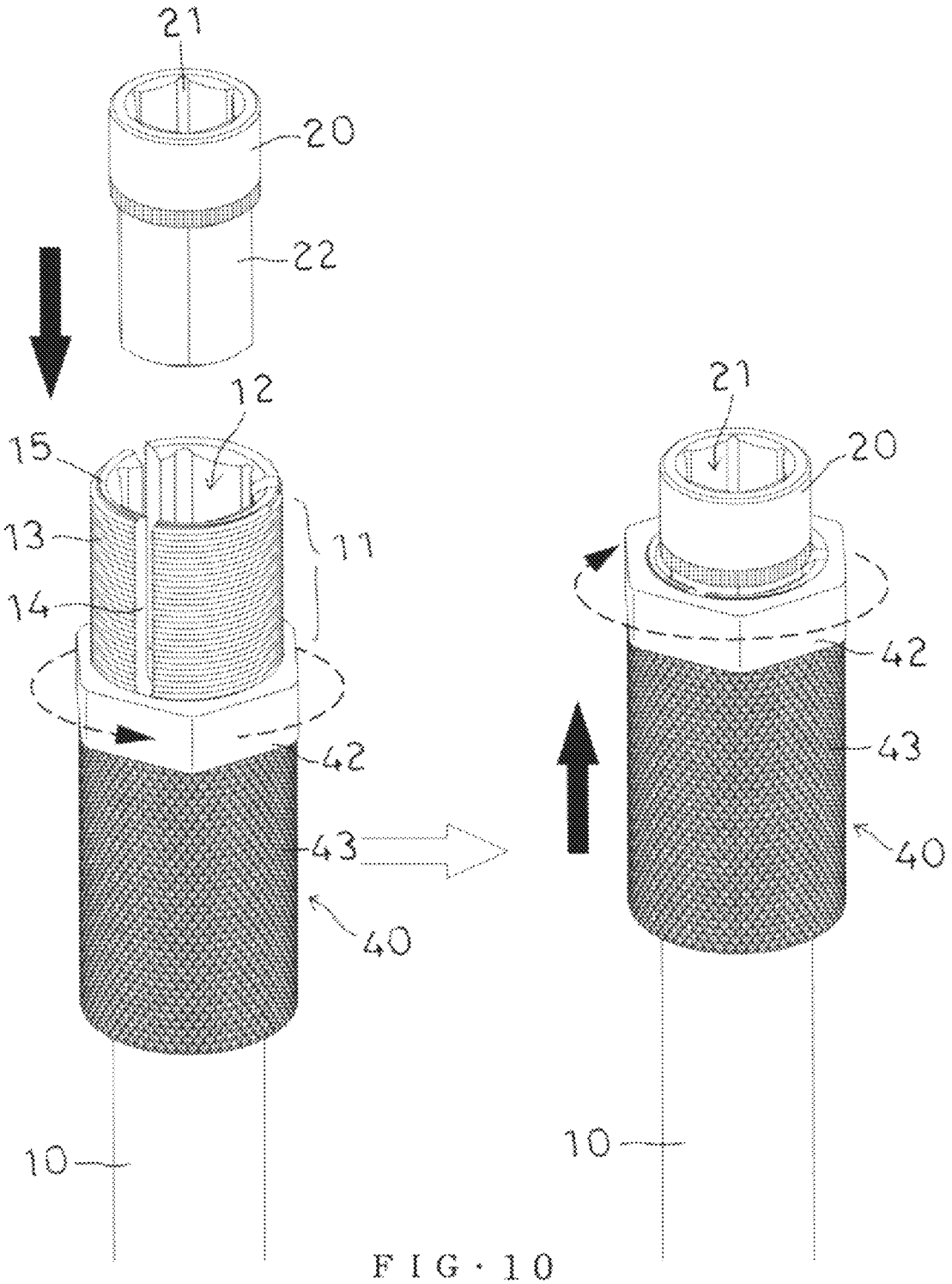
FIG. 10 is a schematic view showing assembly of a drive head of the driving shank assembly in accordance with the first preferred embodiment of the present invention.
Figure 11:
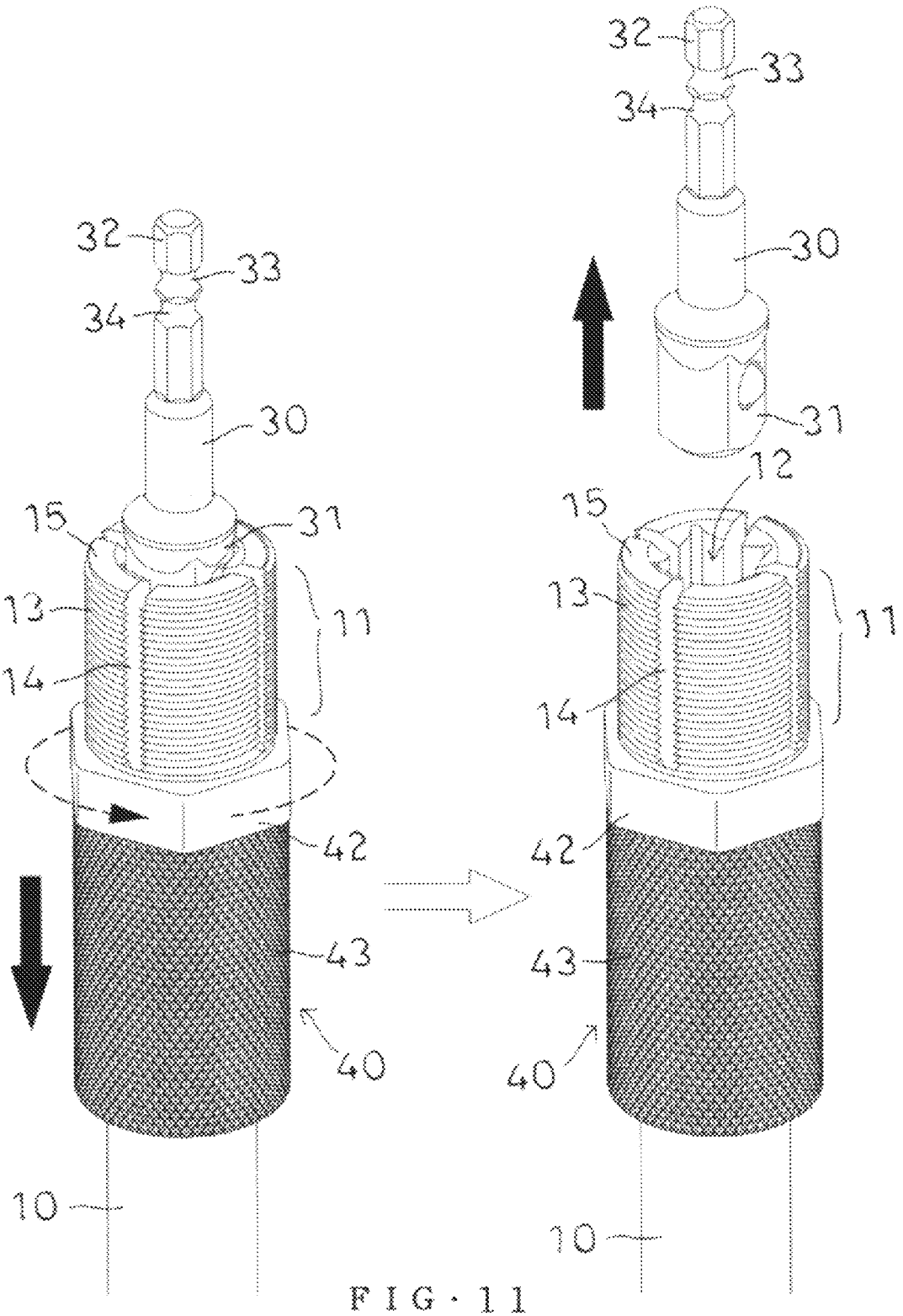
FIG. 11 is a schematic view showing disassembly of a connector of the driving shank assembly in accordance with the first preferred embodiment of the present invention.

In assembly, referring to FIGS. 10 and 11 with reference to FIGS. 5-9, the mounting shaft 22 of the drive head 20 is inserted into the mounting recess 12 of one of the two enlarged portions 11 of the tube 10. Then, one of the two quick release nuts 40 is mounted on the tube 10, with the internal thread 41 thereof being screwed onto the external thread 13 of one of the two enlarged portions 11 of the tube 10, so that the mounting recess 12 of one of the two enlarged portions 11 of the tube 10 is closed, and the elastic clamping pieces 15 of one of the two enlarged portions 11 of the tube 10 are pressed and contracted to lock the mounting shaft 22 of the drive head 20, thereby locking the drive head 20 onto the tube 10. When the internal thread 41 of one of the two quick release nuts 40 is unscrewed from the external thread 13 of one of the two enlarged portions 11 of the tube 10, the mounting recess 12 of one of the two enlarged portions 11 of the tube 10 is opened, and the elastic clamping pieces 15 of one of the two enlarged portions 11 of the tube 10 are expanded elastically to unlock the mounting shaft 22 of the drive head 20, thereby unlocking the drive head 20 from the tube 10.

Similarly, the mounting shaft 31 of the connector 30 is inserted into the mounting recess 12 of the other one of the two enlarged portions 11 of the tube 10. Then, the other one of the two quick release nuts 40 is mounted on the tube 10, with the internal thread 41 thereof being screwed onto the external thread 13 of the other one of the two enlarged portions 11 of the tube 10, so that the mounting recess 12 of the other one of the two enlarged portions 11 of the tube 10 is closed, and the elastic clamping pieces 15 of the other one of the two enlarged portions 11 of the tube 10 are pressed and contracted to lock the mounting shaft 31 of the connector 30, thereby locking the connector 30 onto the tube 10. When the internal thread 41 of one of the two quick release nuts 40 is unscrewed from the external thread 13 of the other one of the two enlarged portions 11 of the tube 10, the mounting recess 12 of the other one of the two enlarged portions 11 of the tube 10 is opened, and the elastic clamping pieces 15 of the other one of the two enlarged portions 11 of the tube 10 are expanded elastically to unlock the mounting shaft 31 of the connector 30, thereby unlocking the connector 30 from the tube 10.

In such a manner, each of the two quick release nuts 40 is screwed onto the tube 10 to lock the drive head 20 and the connector 30, or unscrewed from the tube 10 to unlock the drive head 20 and the connector 30, so that the drive head 20 and the connector 30 are mounted on and detached from the tube 10 easily and quickly. In addition, the drive head 20 and the connector 30 are positioned on the tube 10 solidly and steadily by the two quick release nuts 40.

Figure 12:
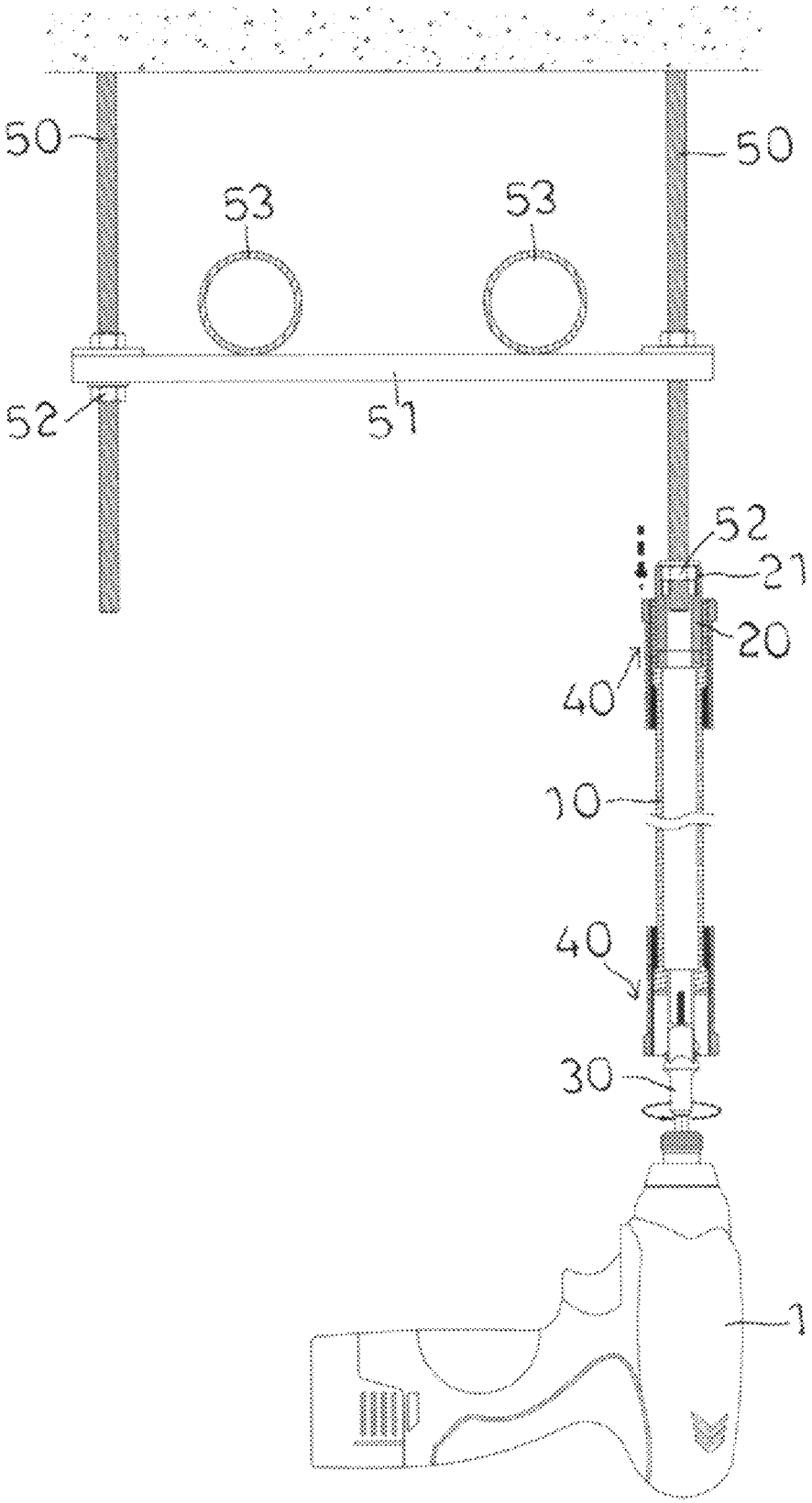
FIG. 12 is a schematic cross-sectional view showing operation of the driving shank assembly using an electric tool.
Figure 13:
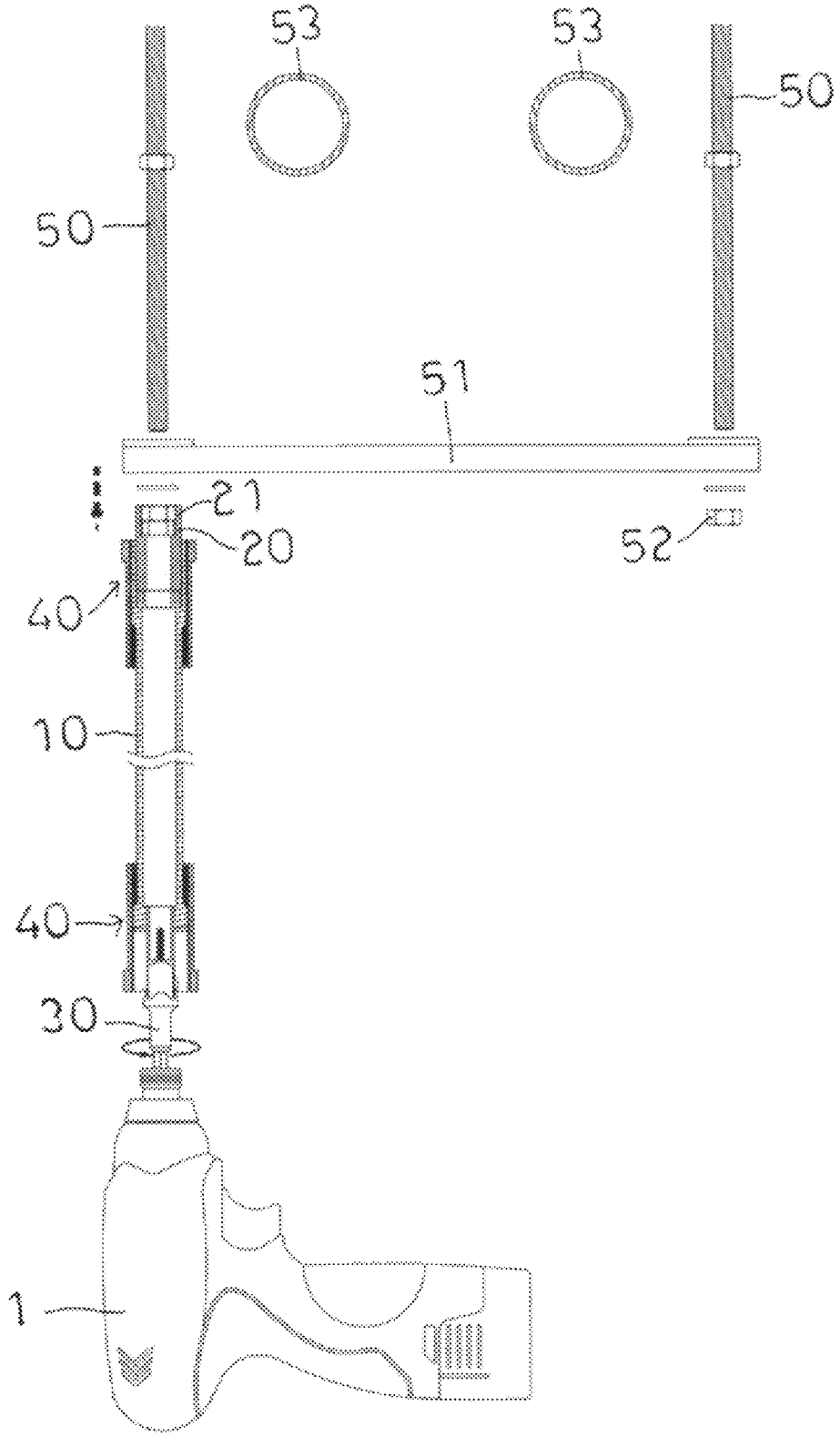
FIG. 13 is another schematic cross-sectional view showing operation of the driving shank assembly using the electric tool.

In practice, referring to FIGS. 12 and 13 with reference to FIGS. 5-9, two bolts 50 are mounted on a ceiling. A support plate (or rack or bracket) 51 is mounted between the two bolts 50. Two nuts 52 are screwed onto the two bolts 50 and rest on the bottom of the support plate 51 to support the support plate 51. Thus, the support plate 51 is used to support at least one pipe 53 which is a vent pipe or a fire hose. The driving recess 21 of the drive head 20 is mounted on each of the two nuts 52. At this time, the tube 10 allows passage of each of the two bolts 50. The electric tool 1 is connected with the connecting shank 32 of the connector 30. In operation, the connector 30 is driven by the electric tool 1 to rotate the tube 10 which rotates the drive head 20 which rotates each of the two nuts 52 so that each of the two nuts 52 is screwed onto or unscrewed from each of the two bolts 50. Thus, the driving shank assembly cooperates with the electric tool 1 to operate each of the two nuts 52 easily and quickly. In such a manner, the tube 10, the drive head 20, and the connector 30 are coaxial with each other and have a circularity (or roundness) therebetween so that the driving shank assembly is driven by the electric tool 1 steadily and will not be deflected or swayed during rotation, thereby facilitating the user operating the driving shank assembly.

Figure 14:
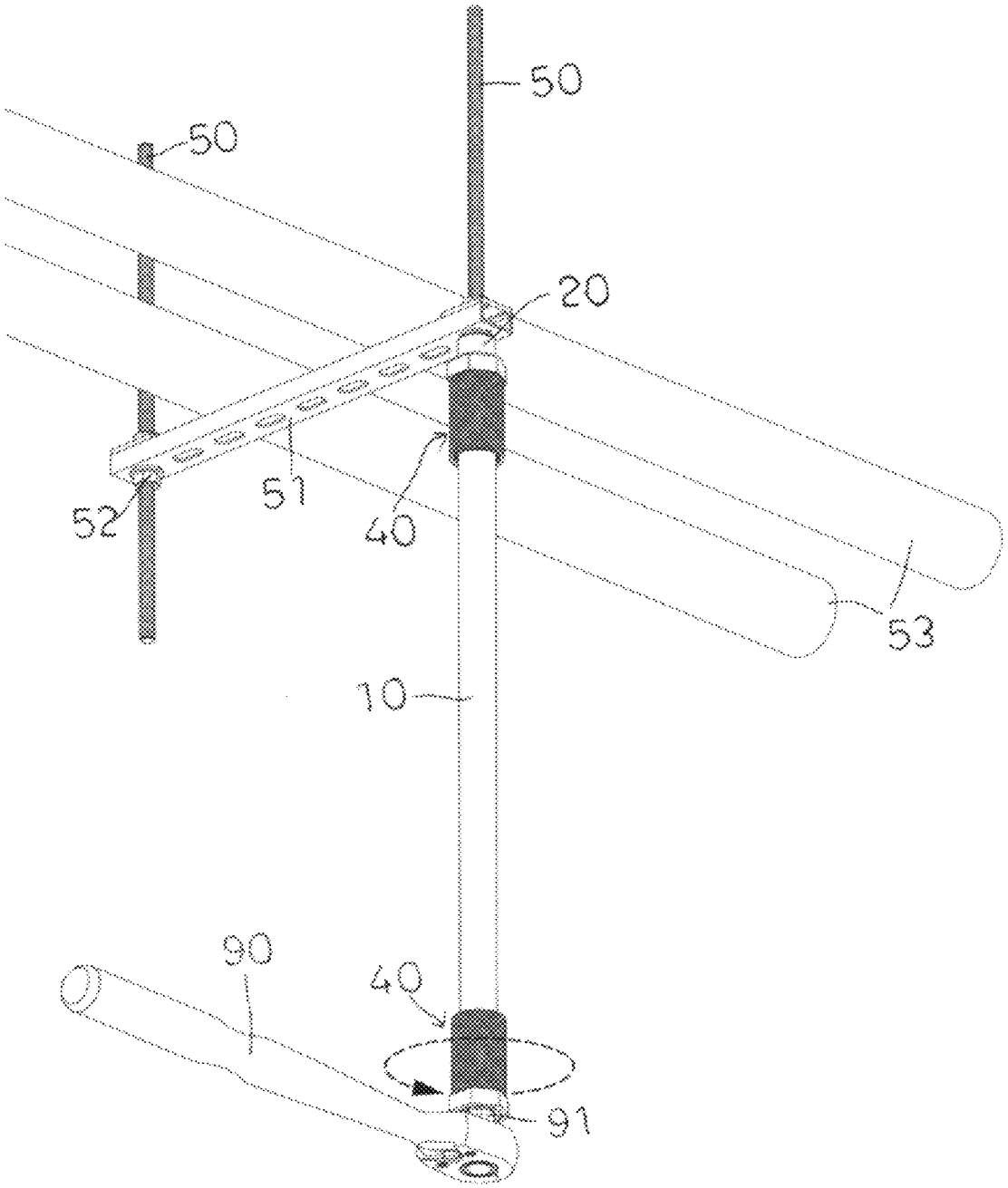
FIG. 14 is a schematic perspective view showing operation of the driving shank assembly using a ratchet wrench.
Figure 15:
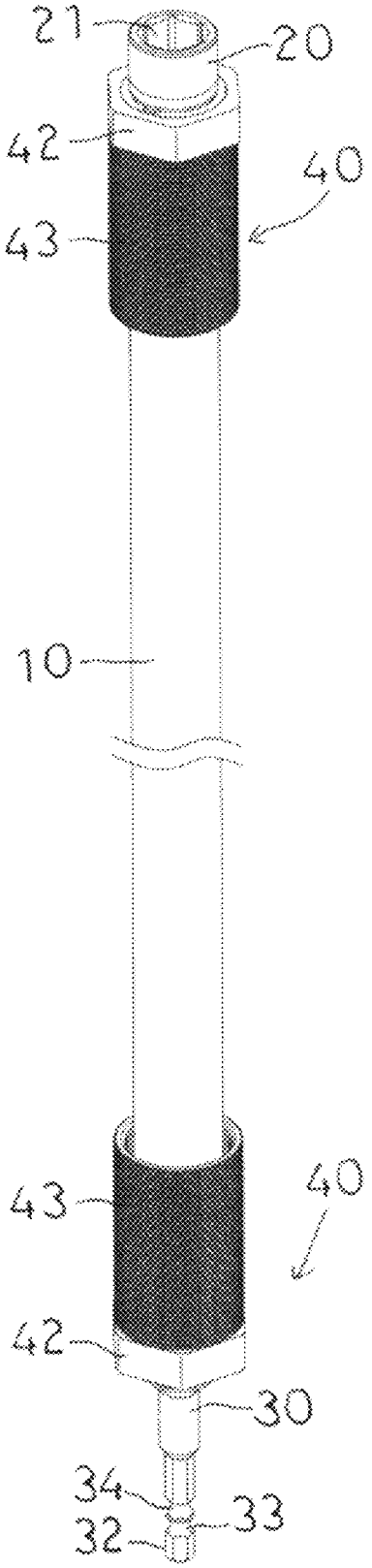
FIG. 15 is a perspective view of a driving shank assembly in accordance with the second preferred embodiment of the present invention.
Figure 16:
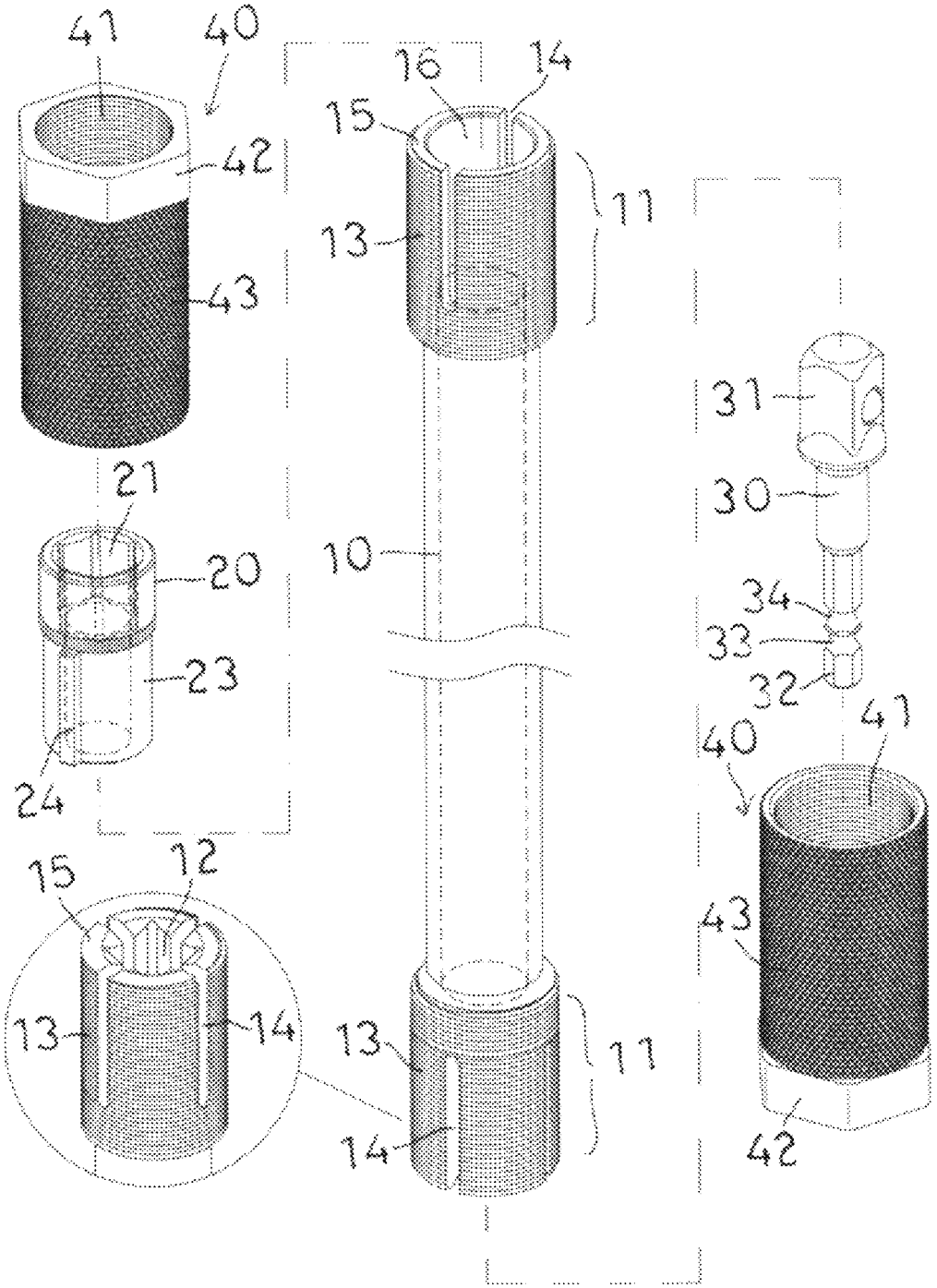
FIG. 16 is an exploded perspective view of the driving shank assembly in accordance with the second preferred embodiment of the present invention.
Figure 17:
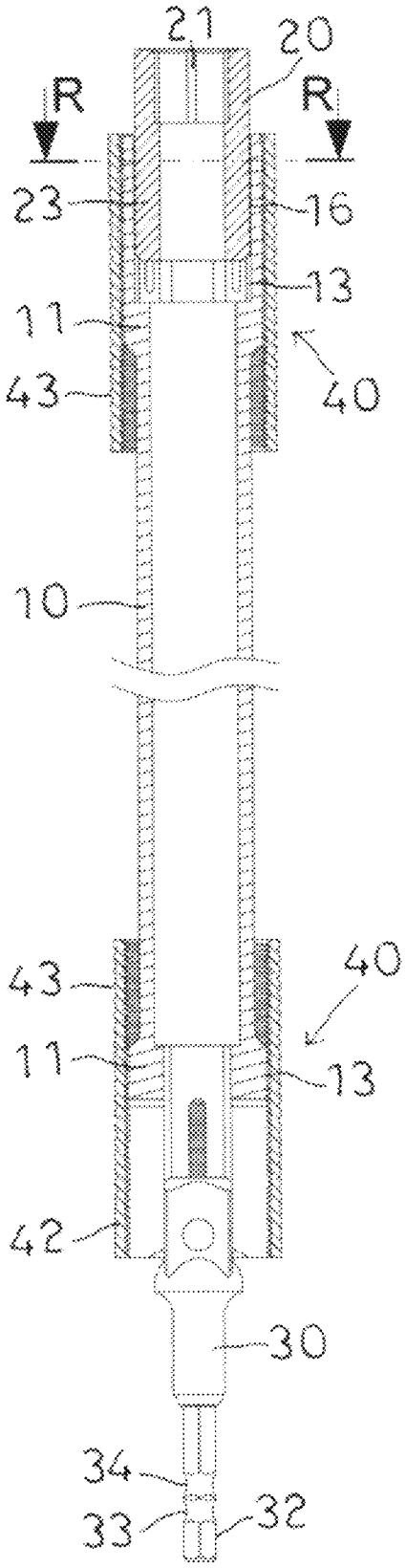
FIG. 17 is a cross-sectional view of the driving shank assembly in accordance with the second preferred embodiment of the present invention.
Figure 18:
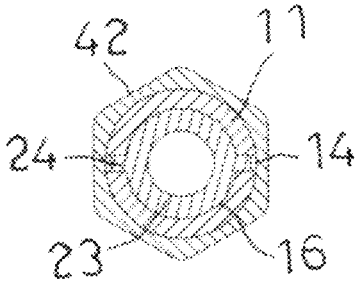
FIG. 18 is a cross-sectional view of the driving shank assembly taken along line R-R as shown in FIG. 17.
Figure 19:
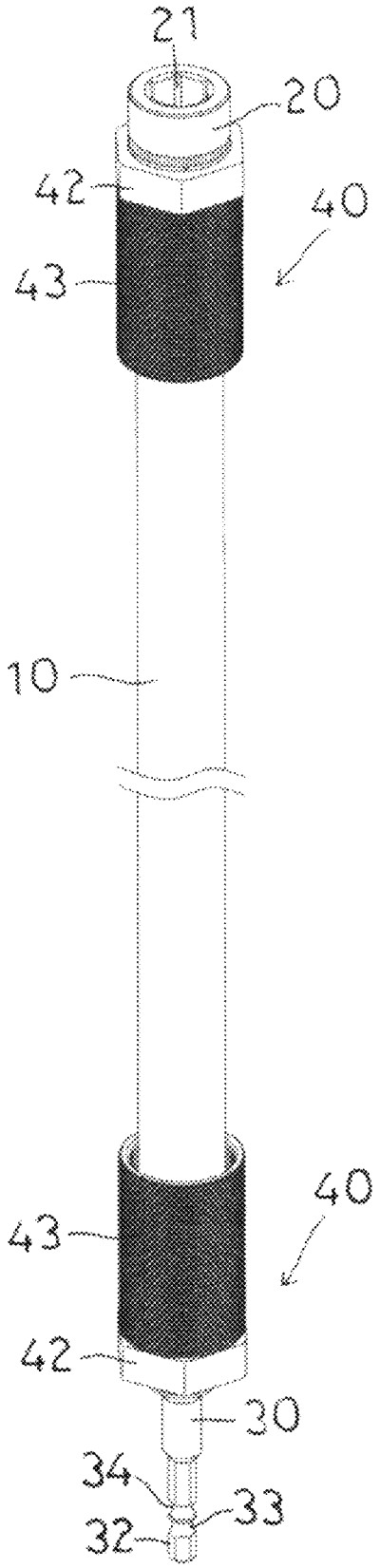
FIG. 19 is a perspective view of a driving shank assembly in accordance with the third preferred embodiment of the present invention.
Figure 20:
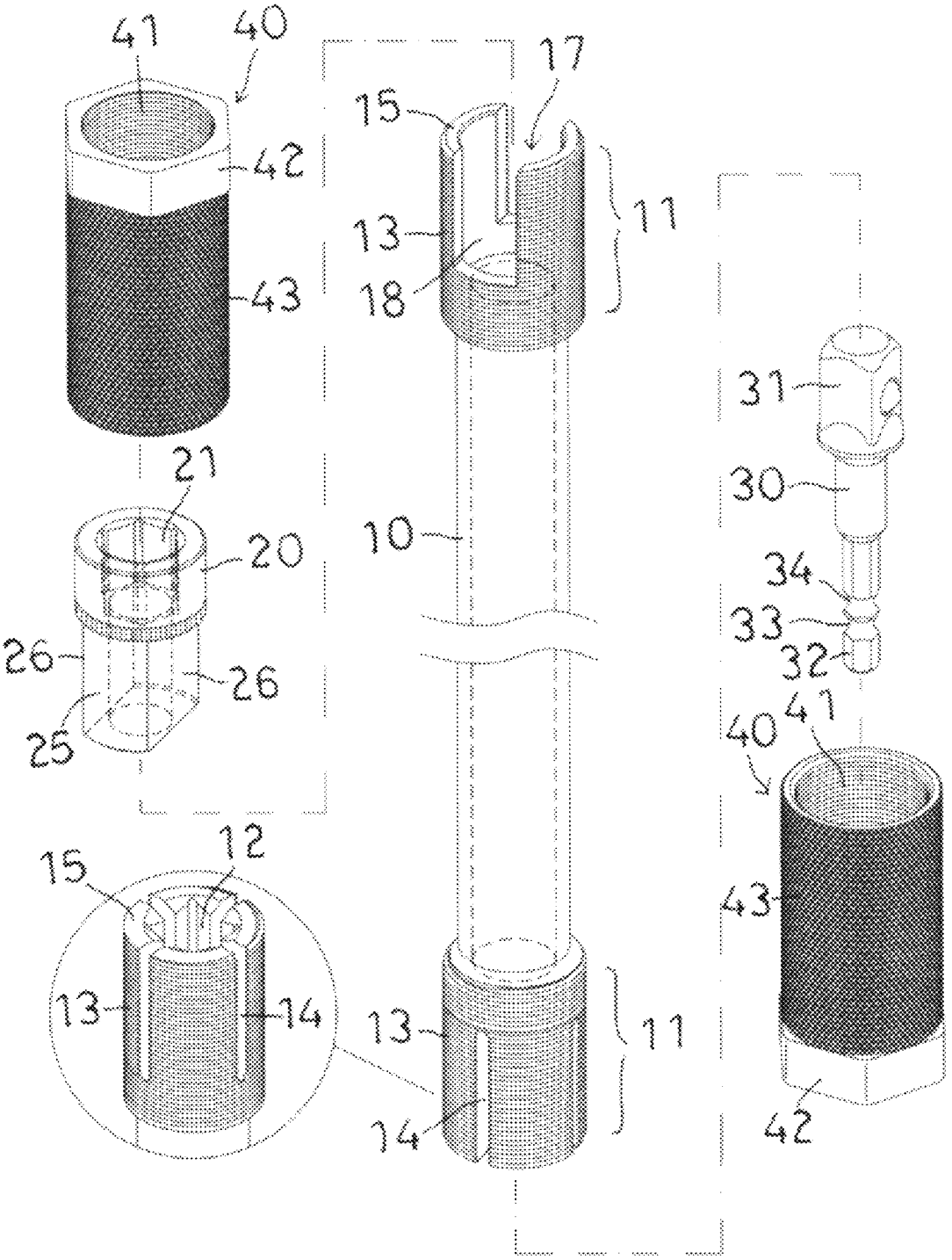
FIG. 20 is an exploded perspective view of the driving shank assembly in accordance with the third preferred embodiment of the present invention.
Figure 21:
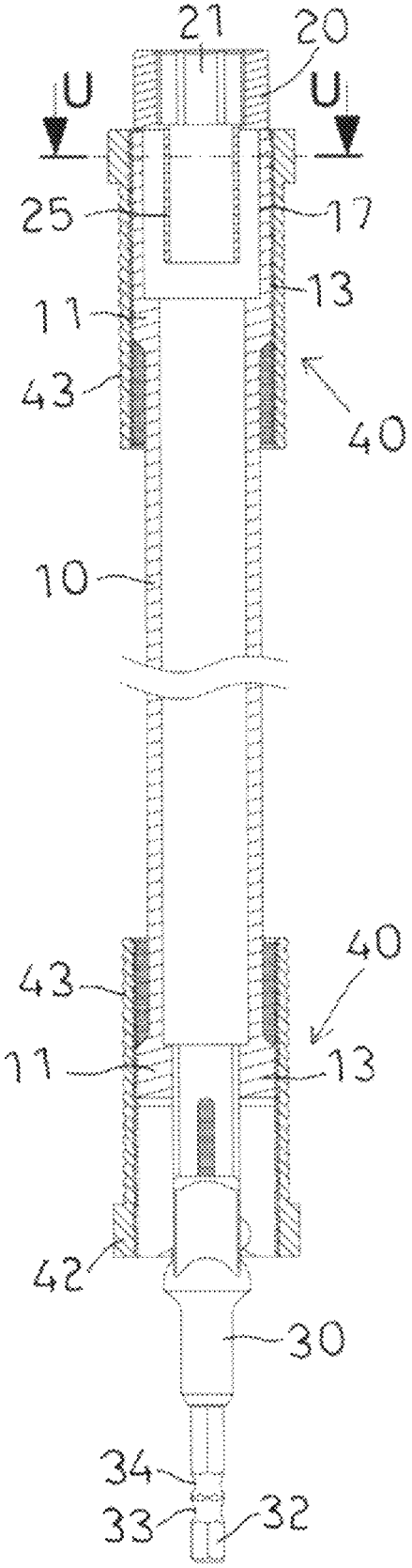
FIG. 21 is a cross-sectional view of the driving shank assembly in accordance with the third preferred embodiment of the present invention.
Figure 22:
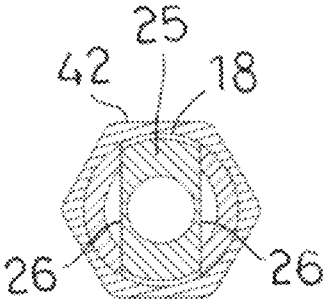
FIG. 22 is a cross-sectional view of the driving shank assembly taken along line U-U as shown in FIG. 21.

Alternatively, referring to FIG. 14 with reference to FIGS. 5-9, the driving shank assembly cooperates with an actuating tool, such as a ratchet wrench 90, which includes a mounting shaft 91. In practice, the connector 30 is removed from the tube 10, and the mounting shaft 91 of the ratchet wrench 90 is inserted into the mounting recess 12 of the tube 10. Thus, the tube 10 is driven by the ratchet wrench 90 to rotate the drive head 20 which rotates each of the two nuts 52 so that each of the two nuts 52 is screwed onto or unscrewed from each of the two bolts 50.

Referring to FIGS. 15-18, a driving shank assembly in accordance with the second preferred embodiment of the present invention comprises a tube 10, a drive head 20, a connector 30, and two quick release nuts 40.

The tube 10 is hollow and has a straight shape. The tube 10 has two enlarged portions 11 formed on two ends thereof. Each of the two enlarged portions 11 has a diameter more than that of the tube 10. Each of the two enlarged portions 11 has an interior provided with a mounting recess 16 and 12 for mounting the drive head 20 and the connector 30 respectively. The mounting recess 16 has a circular shape, and the mounting recess 12 has a square shape. Each of the two enlarged portions 11 has an exterior provided with an external thread 13 for locking and securing the two quick release nuts 40. Each of the two enlarged portions 11 has a periphery provided with a plurality of slits 14 and a plurality of elastic clamping pieces 15 between the slits 14. Each of the slits 14 is connected to the mounting recess 16 and 12 and extends axially along the tube 10. The elastic clamping pieces 15 are made flexible by the slits 14.

The drive head 20 has a first end provided with a driving recess 21 and a second end provided with a mounting shaft 23. The driving recess 21 of the drive head 20 has a hexagonal shape or a square shape. The mounting shaft 23 of the drive head 20 has a circular shape. The mounting shaft 23 of the drive head 20 is inserted into the mounting recess 16 and has an exterior provided with a plurality of positioning wings 24 positioned in the slits 14 of one of the two enlarged portions 11. The drive head 20 has different sizes and specifications corresponding to that of different nuts. A magnetic member is mounted in the driving recess 21 of the drive head 20.

The connector 30 has a first end provided with a mounting shaft 31 and a second end provided with a connecting shank 32. The mounting shaft 31 of the connector 30 has a shape corresponding to that of the mounting recess 12 of the tube 10. Preferably, the mounting shaft 31 of the connector 30 has a hexagonal shape or a square shape. The connecting shank 32 of the connector 30 is provided with two retaining grooves 33 and 34. Each of the two retaining grooves 33 and 34 has an annular shape and is available for the electric tool 1 (FIG. 12) of a U.S. specification or a Japanese specification.

Each of the two quick release nuts 40 has an interior provided with an internal thread 41 screwed onto the external thread 13 of the tube 10. Each of the two quick release nuts 40 has an exterior provided with a driving portion 42. Preferably, the driving portion 42 of each of the two quick release nuts 40 has a hexagonal shape. A wrench tool is mounted on the driving portion 42 to drive and rotate each of the two quick release nuts 40. Each of the two quick release nuts 40 is provided with a knurling (or embossing) portion 42 to increase the friction thereof and to facilitate a user holding and operating each of the two quick release nuts 40.

In assembly, the mounting shaft 23 of the drive head 20 is inserted into the mounting recess 16 of one of the two enlarged portions 11 of the tube 10, with the positioning wings 24 being positioned in the slits 14 of one of the two enlarged portions 11. Then, one of the two quick release nuts 40 is mounted on the tube 10, with the internal thread 41 thereof being screwed onto the external thread 13 of one of the two enlarged portions 11 of the tube 10, so that the mounting recess 16 of one of the two enlarged portions 11 of the tube 10 is closed, and the elastic clamping pieces 15 of one of the two enlarged portions 11 of the tube 10 are pressed and contracted to lock the mounting shaft 23 of the drive head 20, thereby locking the drive head 20 onto the tube 10. When the internal thread 41 of one of the two quick release nuts 40 is unscrewed from the external thread 13 of one of the two enlarged portions 11 of the tube 10, the mounting recess 16 of one of the two enlarged portions 11 of the tube 10 is opened, and the elastic clamping pieces 15 of one of the two enlarged portions 11 of the tube 10 are expanded elastically to unlock the mounting shaft 23 of the drive head 20, thereby unlocking the drive head 20 from the tube 10.

Similarly, the mounting shaft 31 of the connector 30 is inserted into the mounting recess 12 of the other one of the two enlarged portions 11 of the tube 10. Then, the other one of the two quick release nuts 40 is mounted on the tube 10, with the internal thread 41 thereof being screwed onto the external thread 13 of the other one of the two enlarged portions 11 of the tube 10, so that the mounting recess 12 of the other one of the two enlarged portions 11 of the tube 10 is closed, and the elastic clamping pieces 15 of the other one of the two enlarged portions 11 of the tube 10 are pressed and contracted to lock the mounting shaft 31 of the connector 30, thereby locking the connector 30 onto the tube 10. When the internal thread 41 of one of the two quick release nuts 40 is unscrewed from the external thread 13 of the other one of the two enlarged portions 11 of the tube 10, the mounting recess 12 of the other one of the two enlarged portions 11 of the tube 10 is opened, and the elastic clamping pieces 15 of the other one of the two enlarged portions 11 of the tube 10 are expanded elastically to unlock the mounting shaft 31 of the connector 30, thereby unlocking the connector 30 from the tube 10.

In such a manner, each of the two quick release nuts 40 is screwed onto the tube 10 to lock the drive head 20 and the connector 30, or unscrewed from the tube 10 to unlock the drive head 20 and the connector 30, so that the drive head 20 and the connector 30 are mounted on and detached from the tube 10 easily and quickly. In addition, the drive head 20 and the connector 30 are positioned on the tube 10 solidly and steadily by the two quick release nuts 40.

Referring to FIGS. 19-22, a driving shank assembly in accordance with the third preferred embodiment of the present invention comprises a tube 10, a drive head 20, a connector 30, and two quick release nuts 40.

The tube 10 is hollow and has a straight shape. The tube 10 has two enlarged portions 11 formed on two ends thereof. Each of the two enlarged portions 11 has a diameter more than that of the tube 10. Each of the two enlarged portions 11 has an interior provided with a mounting recess 17 and 12 for mounting the drive head 20 and the connector 30 respectively. The mounting recess 17 has a circular shape, and the mounting recess 12 has a square shape. Each of the two enlarged portions 11 has an exterior provided with an external thread 13 for locking and securing the two quick release nuts 40. Each of the two enlarged portions 11 has a periphery provided with a plurality of slits 18 and 14 and a plurality of elastic clamping pieces 15 between the slits 18 and 14. Each of the slits 18 and 14 is connected to the mounting recess 17 and 12 and extends axially along the tube 10. The elastic clamping pieces 15 are made flexible by the slits 18 and 14.

The drive head 20 has a first end provided with a driving recess 21 and a second end provided with a mounting shaft 25. The driving recess 21 of the drive head 20 has a hexagonal shape or a square shape. The mounting shaft 25 of the drive head 20 has a circular shape. The mounting shaft 25 of the drive head 20 is inserted into the mounting recess 17 and has a periphery provided with a plurality of planes 26 positioned in the slits 18 of one of the two enlarged portions 11. The drive head 20 has different sizes and specifications corresponding to that of different nuts. A magnetic member is mounted in the driving recess 21 of the drive head 20.

The connector 30 has a first end provided with a mounting shaft 31 and a second end provided with a connecting shank 32. The mounting shaft 31 of the connector 30 has a shape corresponding to that of the mounting recess 12 of the tube 10. Preferably, the mounting shaft 31 of the connector 30 has a hexagonal shape or a square shape. The connecting shank 32 of the connector 30 is provided with two retaining grooves 33 and 34. Each of the two retaining grooves 33 and 34 has an annular shape and is available for the electric tool 1 (FIG. 12) of a U.S. specification or a Japanese specification.

Each of the two quick release nuts 40 has an interior provided with an internal thread 41 screwed onto the external thread 13 of the tube 10. Each of the two quick release nuts 40 has an exterior provided with a driving portion 42. Preferably, the driving portion 42 of each of the two quick release nuts 40 has a hexagonal shape. A wrench tool is mounted on the driving portion 42 to drive and rotate each of the two quick release nuts 40. Each of the two quick release nuts 40 is provided with a knurling (or embossing) portion 42 to increase the friction thereof and to facilitate a user holding and operating each of the two quick release nuts 40.

In assembly, the mounting shaft 25 of the drive head 20 is inserted into the mounting recess 17 of one of the two enlarged portions 11 of the tube 10, with the planes 26 being positioned in the slits 18 of one of the two enlarged portions 11. Then, one of the two quick release nuts 40 is mounted on the tube 10, with the internal thread 41 thereof being screwed onto the external thread 13 of one of the two enlarged portions 11 of the tube 10, so that the mounting recess 17 of one of the two enlarged portions 11 of the tube 10 is closed, and the elastic clamping pieces 15 of one of the two enlarged portions 11 of the tube 10 are pressed and contracted to lock the mounting shaft 25 of the drive head 20, thereby locking the drive head 20 onto the tube 10. When the internal thread 41 of one of the two quick release nuts 40 is unscrewed from the external thread 13 of one of the two enlarged portions 11 of the tube 10, the mounting recess 17 of one of the two enlarged portions 11 of the tube 10 is opened, and the elastic clamping pieces 15 of one of the two enlarged portions 11 of the tube 10 are expanded elastically to unlock the mounting shaft 25 of the drive head 20, thereby unlocking the drive head 20 from the tube 10.

Similarly, the mounting shaft 31 of the connector 30 is inserted into the mounting recess 12 of the other one of the two enlarged portions 11 of the tube 10. Then, the other one of the two quick release nuts 40 is mounted on the tube 10, with the internal thread 41 thereof being screwed onto the external thread 13 of the other one of the two enlarged portions 11 of the tube 10, so that the mounting recess 12 of the other one of the two enlarged portions 11 of the tube 10 is closed, and the elastic clamping pieces 15 of the other one of the two enlarged portions 11 of the tube 10 are pressed and contracted to lock the mounting shaft 31 of the connector 30, thereby locking the connector 30 onto the tube 10. When the internal thread 41 of one of the two quick release nuts 40 is unscrewed from the external thread 13 of the other one of the two enlarged portions 11 of the tube 10, the mounting recess 12 of the other one of the two enlarged portions 11 of the tube 10 is opened, and the elastic clamping pieces 15 of the other one of the two enlarged portions 11 of the tube 10 are expanded elastically to unlock the mounting shaft 31 of the connector 30, thereby unlocking the connector 30 from the tube 10.

In such a manner, each of the two quick release nuts 40 is screwed onto the tube 10 to lock the drive head 20 and the connector 30, or unscrewed from the tube 10 to unlock the drive head 20 and the connector 30, so that the drive head 20 and the connector 30 are mounted on and detached from the tube 10 easily and quickly. In addition, the drive head 20 and the connector 30 are positioned on the tube 10 solidly and steadily by the two quick release nuts 40.

Accordingly, each of the two quick release nuts 40 is screwed onto the tube 10 to lock the drive head 20 and the connector 30, or unscrewed from the tube 10 to unlock the drive head 20 and the connector 30, so that the drive head 20 and the connector 30 are mounted on and detached from the tube 10 easily and quickly. In addition, the drive head 20 and the connector 30 are positioned on the tube 10 solidly and steadily by the two quick release nuts 40. Further, the tube 10, the drive head 20, and the connector 30 are coaxial with each other and have a circularity therebetween so that the driving shank assembly is driven by the electric tool 1 steadily and will not be deflected or swayed during rotation, thereby facilitating the user operating the driving shank assembly.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A driving shank assembly comprising:

a tube, a drive head, and a quick release nut;

wherein:

the tube is hollow and has a straight shape;

the tube has an enlarged portion formed on one end thereof;

the enlarged portion has an interior provided with a mounting recess for mounting the drive head;

the enlarged portion has an exterior provided with an external thread for locking and securing the quick release nut;

the enlarged portion has a periphery provided with a plurality of slits and a plurality of elastic clamping pieces between the slits;

each of the slits is connected to the mounting recess and extends axially along the tube;

the drive head has a first end provided with a driving recess and a second end provided with a mounting shaft;

the mounting shaft of the drive head is inserted into the mounting recess of the tube;

the quick release nut has an interior provided with an internal thread screwed onto the external thread of the tube;

the mounting recess of the tube has a circular shape, and the mounting shaft of the drive head has a circular shape and has an exterior provided with a plurality of positioning wings positioned in the slits of the tube.

2. The driving shank assembly as claimed in claim 1, wherein a magnetic member is mounted in the driving recess of the drive head.

3. A driving shank assembly comprising:

a tube, a drive head, and a quick release nut;

wherein:

the tube is hollow and has a straight shape;

the tube has an enlarged portion formed on one end thereof;

the enlarged portion has an interior provided with a mounting recess for mounting the drive head;

the enlarged portion has an exterior provided with an external thread for locking and securing the quick release nut;

the enlarged portion has a periphery provided with a plurality of slits and a plurality of elastic clamping pieces between the slits;

each of the slits is connected to the mounting recess and extends axially along the tube;

the drive head has a first end provided with a driving recess and a second end provided with a mounting shaft;

the mounting shaft of the drive head is inserted into the mounting recess of the tube;

the quick release nut has an interior provided with an internal thread screwed onto the external thread of the tube;

the mounting recess of the tube has a circular shape, and the mounting shaft of the drive head has a circular shape and has an exterior provided with a plurality of planes positioned in the slits of the tube.

4. A driving shank assembly comprising:

a tube, a drive head, a connector, and two quick release nuts;

wherein:

the tube is hollow and has a straight shape;

the tube has two enlarged portions formed on two ends thereof;

a first of the two enlarged portions has an interior provided with a first mounting recess and a second of the two enlarged portions has an interior provided with a second mounting recess, both for mounting the drive head and the connector respectively;

each of the two enlarged portions has an exterior provided with an external thread for locking and securing the two quick release nuts;

each of the two enlarged portions has a periphery provided with a plurality of slits and a plurality of elastic clamping pieces between the slits;

each of the slits is connected to the respective first and second mounting recesses of the respective first and second enlarged portions and extends axially along the tube;

the drive head has a first end provided with a driving recess and a second end provided with a mounting shaft;

the mounting shaft of the drive head is inserted into the first mounting recess of the tube;

the connector has a first end provided with a mounting body and a second end provided with a connecting shank;

the mounting body of the connector is inserted into the second mounting recess of the tube;

the connecting shank of the connector is provided with at least one retaining groove for mounting an actuating tool;

the at least one retaining groove has an annular shape;

each of the two quick release nuts has an interior provided with an internal thread screwed onto the external thread of the tube;

the first mounting recess of the tube has a circular shape, and the mounting shaft of the drive head has a circular shape and has an exterior provided with a plurality of positioning wings positioned in the slits of the tube.

5. The driving shank assembly as claimed in claim 4, wherein a magnetic member is mounted in the driving recess of the drive head.

6. The driving shank assembly as claimed in claim 4, wherein the actuating tool is an electric tool.

7. The driving shank assembly as claimed in claim 4, wherein the actuating tool is a ratchet wrench including a mounting shank inserted into the second mounting recess of the tube when the connector is removed from the tube.

8. A driving shank assembly comprising:

a tube, a drive head, a connector, and two quick release nuts;

wherein:

the tube is hollow and has a straight shape;

the tube has two enlarged portions formed on two ends thereof;

a first of the two enlarged portions has an interior provided with a first mounting recess and a second of the two enlarged portions has an interior provided with a second mounting recess, both for mounting the drive head and the connector respectively;

each of the two enlarged portions has an exterior provided with an external thread for locking and securing the two quick release nuts;

each of the two enlarged portions has a periphery provided with a plurality of slits and a plurality of elastic clamping pieces between the slits;

each of the slits is connected to the respective first and second mounting recesses of the respective first and second enlarged portions and extends axially along the tube;

the drive head has a first end provided with a driving recess and a second end provided with a mounting shaft;

the mounting shaft of the drive head is inserted into the first mounting recess of the tube;

the connector has a first end provided with a mounting body and a second end provided with a connecting shank;

the mounting body of the connector is inserted into the second mounting recess of the tube;

the connecting shank of the connector is provided with at least one retaining groove for mounting an actuating tool;

the at least one retaining groove has an annular shape;

each of the two quick release nuts has an interior provided with an internal thread screwed onto the external thread of the tube;

the first mounting recess of the tube has a circular shape, and the mounting shaft of the drive head has a circular shape and has an exterior provided with a plurality of planes positioned in the slits of the tube.

* * * * *